US008287322B2

(12) United States Patent
Jeon

(10) Patent No.: US 8,287,322 B2
(45) Date of Patent: Oct. 16, 2012

(54) INTERFACE CONTACT FOR AN ELECTRICAL CONNECTOR

(75) Inventor: Myoungsoo Jeon, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/896,654

(22) Filed: Oct. 1, 2010

(65) Prior Publication Data

US 2012/0083140 A1 Apr. 5, 2012

(51) Int. Cl.
*H01R 4/48* (2006.01)

(52) U.S. Cl. ..... 439/862

(58) Field of Classification Search ..... 439/862, 439/70, 71, 891
See application file for complete search history.

(56) References Cited

U.S. PATENT DOCUMENTS 1,237,857 A * 8/1917 Averill ..... 439/290
3,317,888 A * 5/1967 Mancini ..... 439/862
3,601,774 A * 8/1971 Stathos et al. ..... 439/637
3,654,592 A * 4/1972 Primorac ..... 439/637
4,109,986 A * 8/1978 Mouissie ..... 439/637
4,157,207 A * 6/1979 Robinson ..... 439/82
4,514,032 A * 4/1985 Lawrence ..... 439/884
4,699,444 A * 10/1987 Isohata ..... 439/839
4,826,440 A * 5/1989 Plocek et al. ..... 439/70
5,174,777 A * 12/1992 Carter ..... 439/290
6,152,790 A * 11/2000 Morris ..... 439/862
6,645,012 B2 * 11/2003 Ito et al. ..... 439/637

* cited by examiner

*Primary Examiner* — Phuong Dinh

(57) ABSTRACT

An electrical connector includes a housing and a contact held by the housing. The contact has a mating interface configured for mating with a mating contact of a mating connector. The contact has a planar side extending to a tip. An interface contact is separately provided from, and coupled to, the mating interface of the contact. The interface contact has a base coupled to the side of the contact proximate to the tip. The interface contact has a spring beam extending from the base away from the side of the contact. The spring beam is configured to engage the mating contact of the mating connector to make an electrical connection between the contact and the mating contact.

18 Claims, 5 Drawing Sheets

INTERFACE CONTACT FOR AN ELECTRICAL CONNECTOR

BACKGROUND OF THE INVENTION

The subject matter herein relates generally to electrical connectors, and more particularly, to interface contacts for electrical connectors.

To meet digital multi-media demands, higher data throughput is often desired for current digital communications equipment. Electrical connectors that interconnect circuit boards must therefore handle ever increasing signal speeds at ever increasing signal densities. One application environment that uses such electrical connectors is in high speed, differential electrical connectors, such as those common in the telecommunications or computing environments. In a traditional approach, two circuit boards are interconnected with one another in a backplane and a daughter board configuration using electrical connectors mounted to each circuit board.

However, signal degradation occurs along the signal transmission lines of the systems. Problem areas include the interfaces between the electrical connectors and the circuit boards, as well as the mating interface between the electrical connectors. At the mating interface between the electrical connectors, difficulties arise in matching a characteristic impedance of the signal transmission line.

A need remains for electrical connectors that create reliable electrical connections between signal contacts at the mating interface thereof. A need remains for electrical connectors that better match the characteristic impedance of the signal transmission lines at the mating interface between the electrical connectors.

BRIEF DESCRIPTION OF THE INVENTION

In one embodiment, an electrical connector is provided that includes a housing and a contact held by the housing. The contact has a mating interface configured for mating with a mating contact of a mating connector. The contact has a planar side extending to a tip. An interface contact is separately provided from, and coupled to, the mating interface of the contact. The interface contact has a base coupled to the side of the contact proximate to the tip. The interface contact has a spring beam extending from the base away from the side of the contact. The spring beam is configured to engage the mating contact of the mating connector to make an electrical connection between the contact and the mating contact.

In another embodiment, an electrical connector system is provided including a backplane connector and a daughtercard connector. The backplane connector includes a housing having a plurality of contacts held by the housing. The housing is configured to be mounted to a backplane circuit board. The contacts have mounting ends being configured to be terminated to the backplane circuit board. The contacts of the backplane connector have mating ends opposite the mounting ends. The daughtercard connector has a housing and a plurality of contacts held by the housing. The housing is configured to be mounted to a daughtercard circuit board. The contacts of the daughtercard connector have mounting ends that are configured to be terminated to the daughtercard circuit board and the contacts have mating ends opposite the mounting ends. Interface contacts are separately provided from, and mounted to, the contacts of either the backplane connector or the daughtercard connector. The interface contacts have bases mounted to the corresponding contacts and spring beams extending from the bases. The spring beams are configured to engage corresponding contacts of the other backplane connector or daughtercard connector when the backplane connector and daughtercard connector are mated together.

In a further embodiment, an electrical connector system is provided that includes a backplane connector and a daughtercard connector. The backplane connector includes a housing having a chamber and contact towers held by the housing. The contact towers have receptacles therein and contacts held by the contact towers. The contacts are exposed within corresponding receptacles and have mounting ends configured to be terminated to a backplane circuit board. The contacts of the backplane connector have mating ends opposite the mounting ends. The daughtercard connector has a housing holding a plurality of contact modules. The contact modules have holders and a plurality of contacts held by the holders. The contact modules have shields between contact modules. The contacts of the daughter card connector have mounting ends being configured to be terminated to a daughtercard circuit board and mating ends opposite the mounting ends. Interface contacts are separately provided from, and mounted to, the contacts of either the backplane connector or the daughtercard connector. The interface contacts have bases mounted to the corresponding contacts and spring beams extending from the bases. The spring beams are configured to engage corresponding contacts of the other backplane connector or daughtercard connector when the backplane connector and daughtercard connector are mated together.

DETAILED DESCRIPTION OF THE INVENTION

Figure 1:
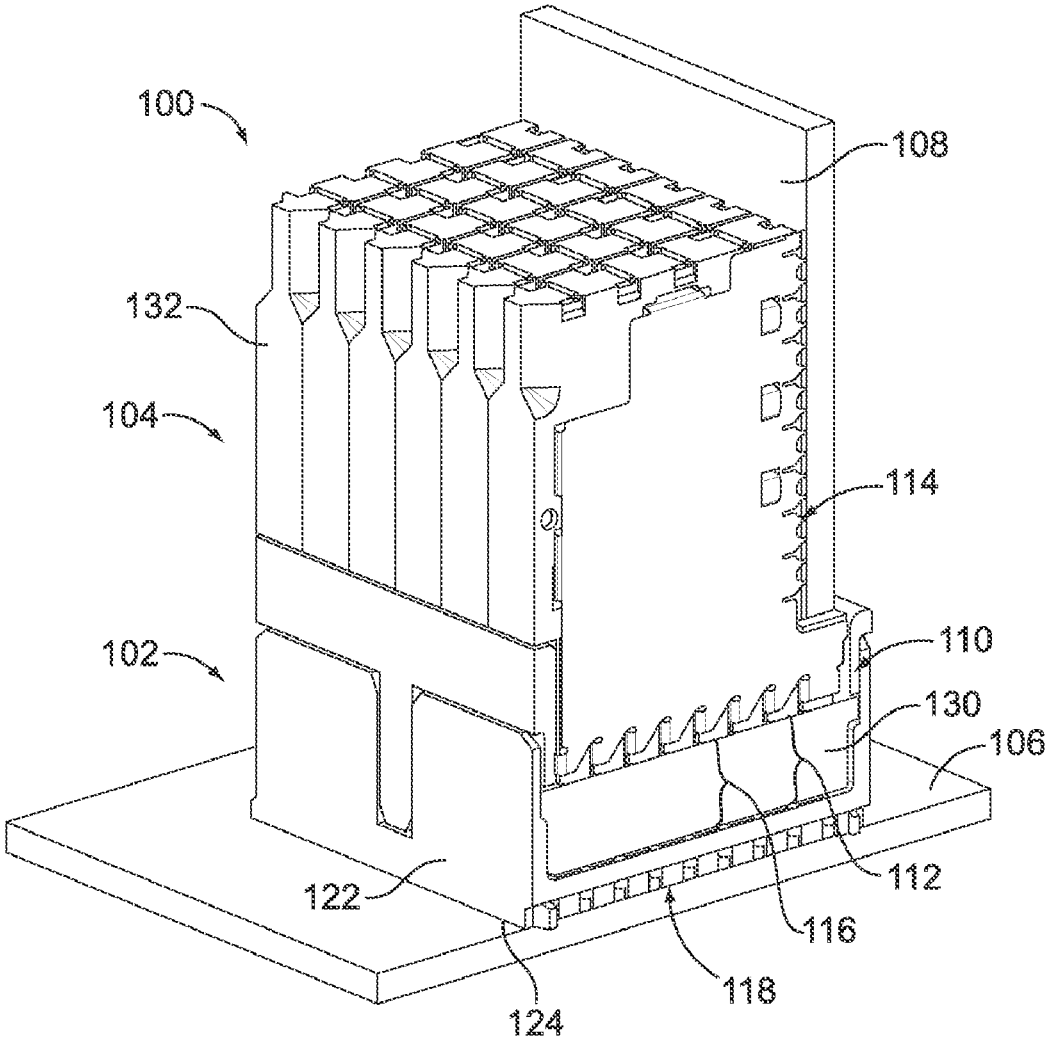
FIG. 1 illustrates an electrical connector system formed in accordance with an exemplary embodiment, showing a backplane connector and a daughtercard connector mated together.

FIG. 1 illustrates an electrical connector system 100 formed in accordance with an exemplary embodiment. The electrical connector system 100 includes a backplane connector 102 and a daughtercard connector 104 that are used to electrically connect a backplane circuit board 106 and a daughtercard circuit board 108. While the electrical connector system 100 is described herein with reference to backplane connectors 102 and daughtercard connector 104, it is realized that the subject matter herein may be utilized with different types of electrical connectors other than a backplane connector or a daughtercard connector. The backplane connector 102 and the daughtercard connector 104 are merely illustrative of an exemplary embodiment of an electrical connector system 100 that interconnects a particular type of circuit board, namely a backplane circuit board, with a daughtercard circuit board.

In alternative embodiments, other types of electrical connectors may be utilized. The electrical connectors may be used to electrically connect other types of circuit boards, other than backplane and daughtercard circuit boards. In other alternative embodiments, rather than having board mounted electrical connectors, the electrical connector system 100 may be utilized with one or more cable mounted connectors.

In the illustrated embodiment, the backplane connector 102 constitutes a header connector mounted to the backplane circuit board 106. The backplane connector 102 includes a chamber 110 that receives the daughtercard connector 104 therein. The daughtercard connector 104 is electrically connected to the backplane connector 102 within the chamber 110. The daughtercard connector 104 is received in the chamber 110 such that the daughtercard circuit board 108 is oriented generally perpendicular with respect to the backplane circuit board 106.

The daughtercard connector 104 constitutes a right angle connector wherein a mating interface 112 and mounting interface 114 of the daughtercard connector 104 are oriented perpendicular to one another. The daughtercard connector 104 is mounted to the daughtercard circuit board 108 at the mounting interface 114.

The backplane connector 102 includes a mating interface 116 and a mounting interface 118 that are oriented generally parallel to one another. The backplane connector 102 is mounted to the backplane circuit board 106 at the mounting interface 118.

The backplane connector 102 includes a housing 122 defining the chamber 110. The housing 122 has a mounting end 124 that is mounted to the backplane circuit board 106. The housing 122 holds a plurality of individual contacts (shown in FIG. 4) that extend between the mating interface 116 and the mounting interface 118.

The daughtercard connector 104 includes a housing 130 holding a plurality of contact modules 132 therein. The contact modules 132 hold individual contacts (shown in FIG. 3) that extend between the mating interface 112 and the mounting interface 114.

As described in further detail below, the electrical connector system 100 includes a plurality of interface contacts 120 (shown in FIG. 2) arranged at the mating interfaces 112, 116. The interface contacts 120 are utilized to electrically connect the backplane connector 102 and the daughtercard connector 104. The interface contacts 120 may control a characteristic impedance along the signal transmission lines defined across the mating interfaces 112, 116. The interface contacts 120 may control electrical characteristics at the mating interfaces 112, 116, such as by controlling the insertion loss, the return loss, or other electrical characteristics.

Figure 2:
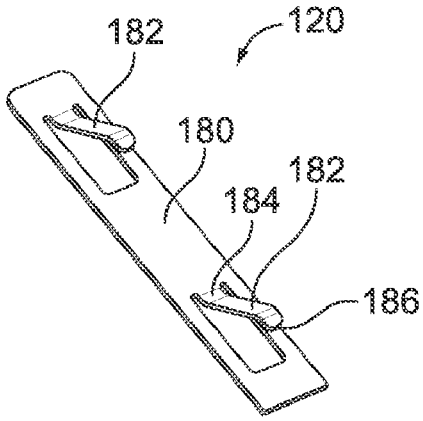
FIG. 2 is a front perspective view of an interface contact for use with the electrical connector system.

FIG. 2 is a front perspective view of one of the interface contacts 120. The interface contact 120 has a base 180 and one or more spring beams 182 extending from the base 180. In an exemplary embodiment, the interface contact 120 is stamped and formed from a metal sheet, such as a copper blank. The interface contact 120 may be plated with a conductive layer to enhance the electrical characteristics of the interface contact 120.

The spring beams 182 have a fixed end 184 and a free end 186. The fixed end 184 is provided at the base 180. The spring beam 182 extends from the fixed end 184 away from the base 180 such that the free end 186 is out of plane with respect to the base 180. The spring beams 182 are deflectable during mating with the corresponding contact, and provide a spring force against such contact when deflected. Any number of spring beams 182 may be provided. In the illustrated embodiment, the interface contact 120 includes two spring beams 182 which are located proximate to the opposite top and bottom ends of the base 180.

The interface contact 120 is configured to be mounted to another, larger contact to create an interface with a corresponding mating contact. The interface contact 120 is relatively small compared to the contacts that the interface contact 120 is used to electrically connect. The interface contact 120 may be referred to as a micro-contact because the interface contact 120 is so much smaller than such other contacts. For example, the interface contact 120 may be less than half the size of the other contacts. The interface contact 120 is separate and discrete from such contacts. The interface contact 120 may be permanently mounted to one of the contacts, but define a separable interface for the other contact.

Figure 3:
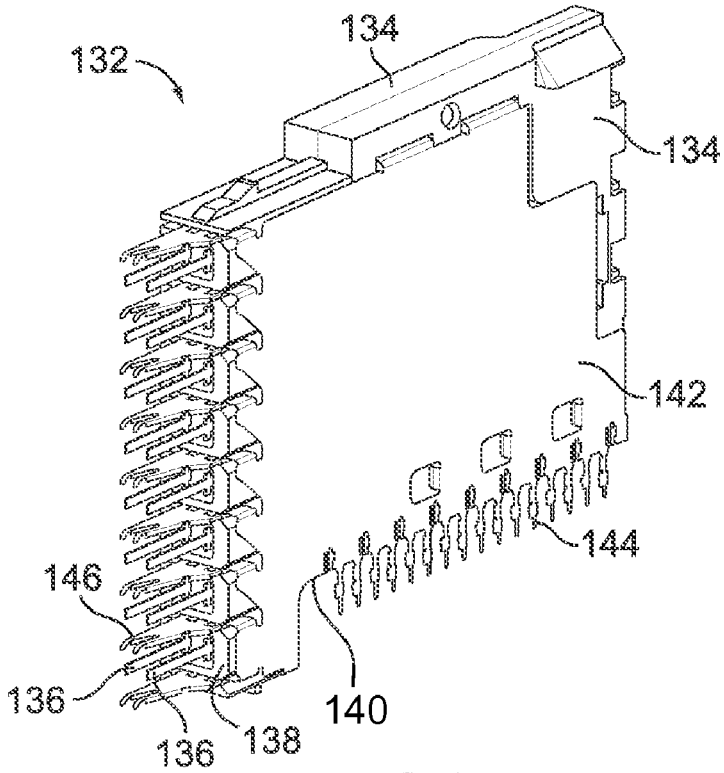
FIG. 3 is a front perspective view of a contact module for the daughtercard connector shown in FIG. 1.

FIG. 3 is a front perspective view of one of the contact modules 132 for the daughtercard connector 104 (shown in FIG. 1). The contact module 132 includes a pair of holders 134 that hold a plurality of contacts 136. In an exemplary embodiment, the contacts 136 are arranged in pairs, with each pair carrying differential signals. Each of the contacts 136 within the pair may be held by a different holder 134 and arranged adjacent to the corresponding contact 136 within the pair. Optionally, the holders 134 may be manufactured from a dielectric material, which are then metallized. Alternatively, the holders 134 may not be metallized. In other alternative embodiments, the holders 134 may be manufactured from a metal material, with a dielectric inner holder that surrounds the contacts 136 to isolate the contacts 136 from the metal outer holder.

In an exemplary embodiment, the holders 134 are overmolded over the contacts 136. The holders 134 may then be metalized. Alternatively, the holders 134 may include an inner holder and outer holders, wherein the inner holder is overmolded around the contacts 136 and then the outer holders create a shell around the inner holder. The inner holder may be dielectric and the outer holders may be metal or metallized plastic.

The contacts 136 extend from a mating end 138 of the corresponding holder 134 and a mounting end 140 of the corresponding holder 134. In the illustrated embodiment, the mating end 138 and the mounting end 140 are perpendicular to each other. The portions of the contacts 136 extending from the mounting end 140 are configured to be mounted to the daughtercard circuit board 108 (shown in FIG. 1). In an exemplary embodiment, the portions of the contacts 136 extending from the mounting end 140 constitute compliant pins, such as eye-of-the-needle pins, that are press-fit into corresponding vias in the daughtercard circuit board 108. The contacts 136 may have different features in alternative embodiments for terminating the contacts 136 to the daughtercard circuit board 108 in a different way. The portions of the contacts 136 extending from the mating end 138 are configured to be electrically connected to corresponding contacts of the backplane connector 102. Optionally, the interface contacts 120 (shown in FIG. 2) may be mounted to the portions of the contacts 136 extending from the mating end 138.

The contact module 132 includes a shield 142 coupled to a side of the holder 134. The shield 142 provides an electrical pathway between the holders 134 and the daughtercard circuit board 108. Optionally, the shield 142 may provide electrical shielding between contact modules 132 when the contact modules 132 are loading into the housing 130 (shown in FIG. 1). In an exemplary embodiment, the shield 142 is electrically grounded. For example, the shield 142 may include ground pins 144 that are received in corresponding vias in the daughtercard circuit board 108 to electrically ground the shield 142 to one or more ground layers of the daughtercard circuit board 108. The shield 142 includes shield fingers 146 that extend forward from a front of the shield 142 and forward from the mating end 138 of the holder 134. The shield fingers 146 are positioned between the contacts 136 to provide electrical shielding between the contacts 136 at the mating interface thereof.

In an alternative embodiment, rather than a separate shield 142 coupled to the holder 134, the contact module 132 may include ground contacts that extend through the holder 134. For example, the ground contacts may be embedded within the holder 134. The holder 134 may be overmolded over the ground contacts which extend between the mating end 138 and the mounting end 140. Alternatively, the holders 134 may include or hold shield fingers and ground pins.

Figure 4:
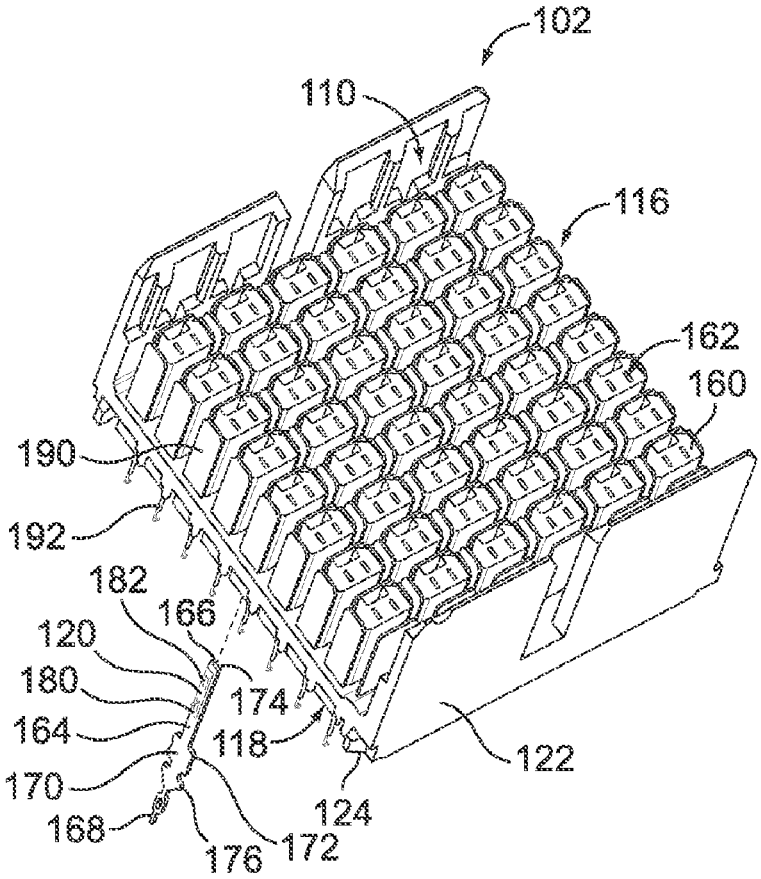
FIG. 4 is a top perspective view of the backplane connector shown in FIG. 1.

FIG. 4 is a top perspective view of the backplane connector 102. The housing 122 includes a plurality of contact towers 160 extending into the chamber 110. The contacts towers 160 include receptacles 162 therein that receive contacts 164 of the backplane connector 102. For example, the contacts 164 may be loaded into the receptacles 162 through a bottom of the receptacles 162. The contacts 164 are exposed within the receptacles 162 and are configured for mating engagement with the contacts 136 (shown in FIG. 3) of the daughtercard connector 104 (shown in FIG. 1). The contacts 136 are loaded into the receptacles 162 when the daughtercard connector 104 is mated to the backplane connector 102. In an exemplary embodiment, each contact tower 160 includes two receptacles 162 that receive a pair of contacts 164. The pair of contacts 164 constitutes a differential pair of contacts that carry differential signals.

In an exemplary embodiment, the interface contacts 120 are mounted to the contacts 164 and loaded into the receptacles 162 with the contacts 164. The contacts 164 and interface contacts 120 are loaded into the receptacles 162 as a unit. FIG. 4 illustrates one of the contacts 164 poised for loading into the corresponding receptacle 162. The interface contact 120 is shown mounted to the contact 164. In an exemplary embodiment, the interface contact 120 is separately provided from the contact 164. For example, the interface contact 120 may be separately manufactured and mounted to the contact 164 prior to loading the contact 164 into the receptacle 162.

The contact 164 extends between a mating end 166 and a mounting end 168. The contact 164 has generally planar sides 170, 172 extending to a tip 174 at the mating end 166. The mounting end 168 is configured to be terminated to the backplane circuit board 106 (shown in FIG. 1). In an exemplary embodiment, the contact 164 includes a compliant pin at the mounting end 168 that is configured to be received in a corresponding via in the backplane circuit board 106. The contact 164 includes barbs or lances 176 that extend therefrom. The barbs 176 engage boundary walls of the receptacles 162 when the contacts 164 are loaded into the receptacles 162. The barbs 176 hold the contacts 164 within the receptacles 162, such as by an interference fit.

The interface contact 120 is mounted to the side 170 proximate to the tip 174 at the mating end 166. The interface contact 120 may be mechanically secured to the side 170 by a welding process such as spot welding or laser welding the interface contact 120 to the contact 164. The interface contact 120 may be secured to the contact 164 by other processes or means, such as soldering, using a conductive adhesive or epoxy, crimping, or other securing processes. In an exemplary embodiment, the base 180 is generally planar and is mounted to the side 170 of the contact 164. The spring beams 182 extend from the base 180 away from the side 170 of the contact 164. The spring beams 182 are configured to engage the contact 136 of the daughtercard connector 104 to make an electrical connection between the contact 164 and the contact 136 of the daughtercard connector 104. For example, the free end 186 (shown in FIG. 2) is configured to engage the contact 136 when the daughtercard connector 104 is coupled to the backplane connector 102. Having multiple spring beams 182 provides multiple points of contact between the contact 164 and the contact 136.

The interface contact 120 is relatively small compared to the contact 164. The interface contact 120 is stamped and formed from a blank that is thinner than the contact 164. For example, the contact 164 may be stamped and formed from a blank having a thickness measured between the sides 170, 172 that is approximately four times greater than a thickness of the interface contact 120. In the illustrated embodiment, the interface contact 120 is manufactured from a sheet of material having a thickness of approximately 0.002 inches and the contact 164 is manufactured from a material having a thickness of approximately 0.008 inches.

The backplane connector 102 includes a plurality of shields 190 coupled to the housing 122. The shields 190 extend along the contact towers 160. In an exemplary embodiment, the shields 190 are provided on all sides of the contact tower 160 to provide circumferential shielding around the contact towers 160. The shields 190 may be electrically grounded. For example, the shields 190 include ground pins 192 extending from the mounting end 124. The ground pins 192 are received in vias in the backplane circuit board 106 and are electrically grounded to one or more ground layers of the backplane circuit board 106. In an exemplary embodiment, when the daughtercard connector 104 is mated to the backplane connector 102 the shield fingers 146 (shown in FIG. 3) of the shields 142 (shown in FIG. 3) engage the shields 190 to electrically common the shields 190 and the shields 142.

Figure 5:
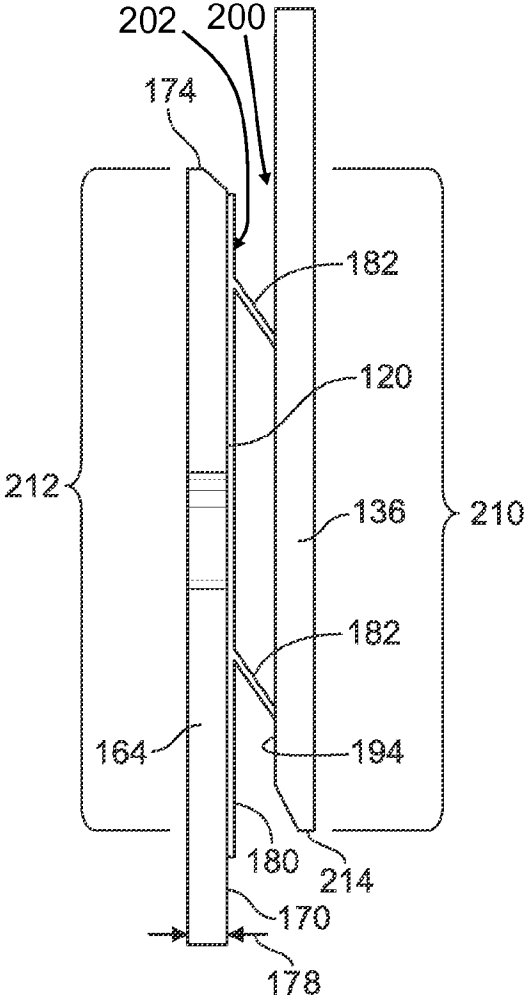
FIG. 5 illustrates the interface contact electrically connected between a contact of the backplane connector and a contact of the daughtercard connector.

FIG. 5 illustrates the interface contact 120 electrically connected between one of the contacts 164 of the backplane connector 102 (shown in FIG. 1) and one of the contacts 136 of the daughtercard connector 104 (shown in FIG. 1). The interface contact 120 is mounted to the side 170 of the contact 164 proximate to the tip 174. The interface contact 120 is held in position with respect to the contact 164 by a mechanical attachment therebetween, such as a welded attachment. The base 180 is relatively thin compared to the thickness 178 of the contact 164. The spring beams 182 extend outward from the base 180 away from the contact 164.

When the daughtercard connector 104 is mated with the backplane connector 102, the contacts 136 are positioned adjacent the contacts 164 such that a side 194 of the contact 136 faces the side 170 of the contact 164. The side 194 is generally planar. The spring beams 182 engage the side 194 and define a separable interface for mating with the contact 136. An electrical connection is made between the contacts 164, 136 by the interface contact 120. Having multiple spring beams 182 provides multiple points of contact with the contact 136. Having many points of contact may be desirable when interconnecting certain types of contacts, such as power contacts, because having a large number of connections decreases the resistance and allows more power to be transmitted across the interface.

The contacts 136, 164 have overlapping sections 210, 212, respectively. The overlapping sections 210, 212 define mating interfaces 200, 202 of the contacts 136, 164. The mating interfaces 200, 202 are the portions of the contacts 136, 164 that face one another and that are configured to be mated together. The interface contact 120 is positioned between the overlapping sections 210, 212. The interface contact 120 is electrically connected to the mating interface 200 of the contact 136 and the mating interface 202 of the contact 164. In an exemplary embodiment, the interface contact 120 has spring beams 182 positioned proximate to both ends of the overlapping sections 210, 212. For example, the interface contact 120 has one spring beam 182 provided proximate to a tip 214 of the contact 136. A different spring beam 182 is provided proximate to the tip 174 of the contact 164. Having spring beams 182 proximate to the ends reduces the occurrence and/or effect of an electrical stub. Less contact stub length provides better electrical throughput at the interface between the contacts 136, 164.

Figure 6:
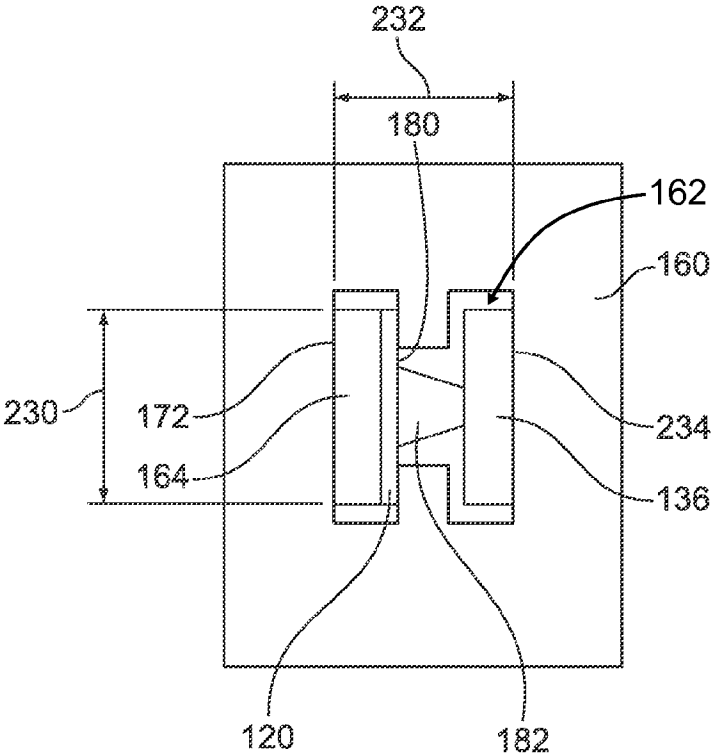
FIG. 6 is a cross-sectional view of a portion of the backplane connector showing the interface contact electrically connected between a contact of the backplane connector and a contact of the daughtercard connector.

FIG. 6 is a cross sectional view of a portion of the electrical connector system 100 through one of the contact towers 160, showing the interface contact 120 electrically connected between the contacts 136, 164. The contact 164 provides mechanical stiffness for the interface contact 120 when the interface contact 120 is mounted thereto.

Both contacts 136, 164 constitute blade type contacts that are generally flat and arranged parallel with one another within the receptacle 162. The interface between the contacts 136, 164 has a small sectional area, defined by a width 230 of the contacts 136, 164 and a spacing 232 between the outer sides 172, 234 of the contacts 164, 136, respectively. The sectional area of the mating interface is relatively small as compared to other types of contacts, such as socket contacts or tuning fork type contacts wherein one of the contacts is arranged on both sides of the other contact. Having a small sectional area at the mating interface allows for tighter control of the impedance of the signal transmission line at the mating interface. The spring beams 182 create an ultra small electrical connection between the contacts 136, 164.

Figure 7:
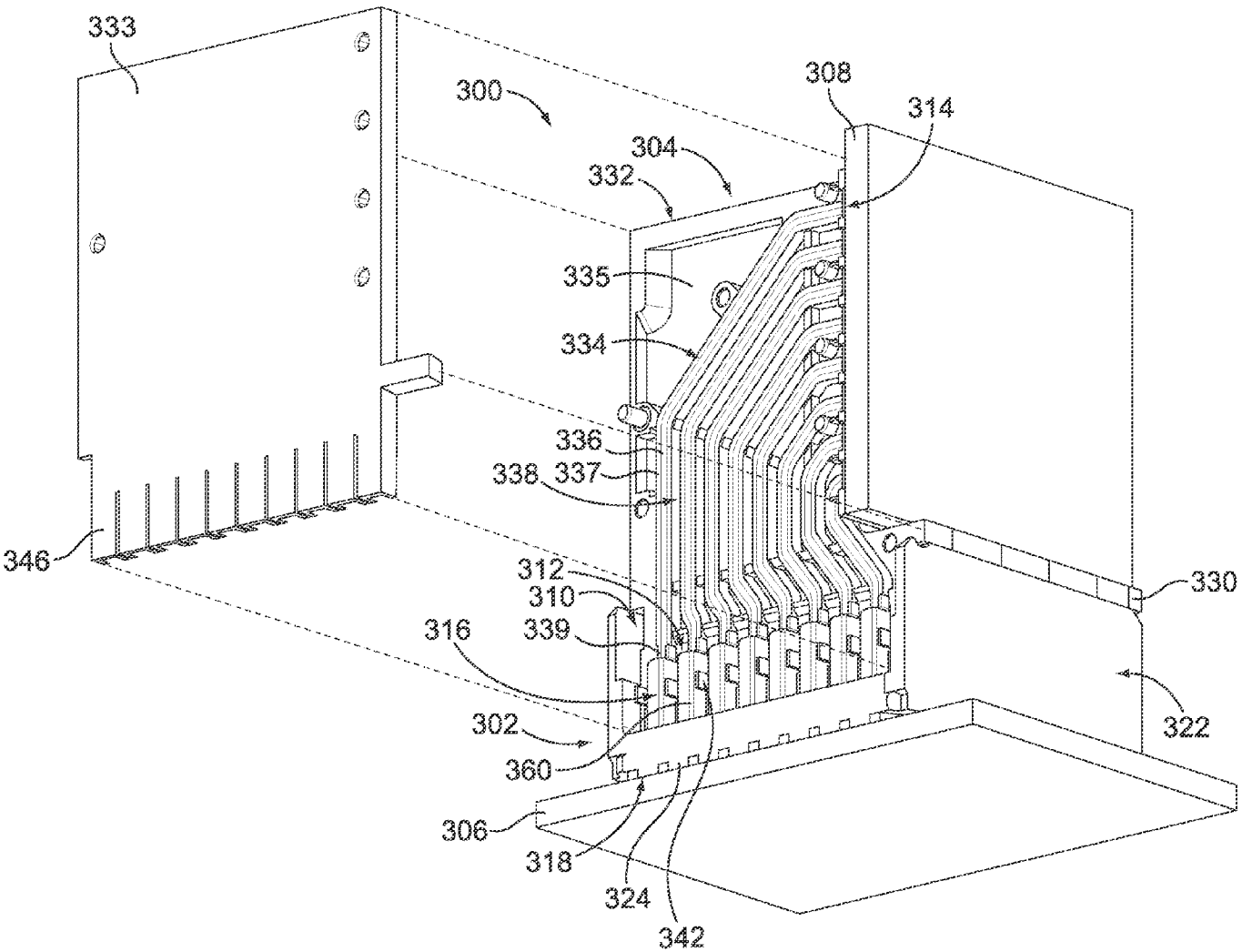
FIG. 7 illustrates an electrical connector system formed in accordance with an alternative embodiment, showing a backplane connector and a daughtercard connector in a mated state.

FIG. 7 illustrates an electrical connector system 300 formed in accordance with an alternative embodiment. The electrical connector system 300 includes a backplane connector 302 and a daughtercard connector 304 that are used to electrically connect a backplane circuit board 306 and a daughtercard circuit board 308. Other types of electrical connectors may be utilized may be used in alternative embodiments other than backplane and daughtercard connectors.

In the illustrated embodiment, the backplane connector 302 constitutes a header connector mounted to the backplane circuit board 306. The backplane connector 302 includes a chamber 310 that receives the daughtercard connector 304 therein. The daughtercard connector 304 is electrically connected to the backplane connector 302 within the chamber 310. The daughtercard connector 304 is received in the chamber 310 such that the daughtercard circuit board 308 is oriented generally perpendicular with respect to the backplane circuit board 306.

The daughtercard connector 304 constitutes a right angle connector wherein a mating interface 312 and mounting interface 314 of the daughtercard connector 304 are oriented perpendicular to one another. The daughtercard connector 304 is mounted to the daughtercard circuit board 308 at the mounting interface 314.

The backplane connector 302 includes a mating interface 316 and a mounting interface 318 that are oriented generally parallel to one another. The backplane connector 302 is mounted to the backplane circuit board 306 at the mounting interface 318.

As described in further detail below, the electrical connector system 300 includes a plurality of interface contacts 320 (shown in FIG. 8) arranged at the mating interfaces 312, 316. The interface contacts 320 may be similar to the interface contacts 120 (shown in FIG. 4). The interface contacts 320 are utilized to electrically connect the backplane connector 302 and the daughtercard connector 304. The interface contacts 320 may control a characteristic impedance along the signal transmission lines defined across the mating interfaces 312, 316. The interface contacts 320 may control electrical characteristics at the mating interfaces 312, 316, such as by controlling the insertion loss, the return loss, or other electrical characteristics.

The backplane connector 302 includes a housing 322 defining the chamber 310. The housing 322 has a mounting end 324 that is mounted to the backplane circuit board 306. The housing 322 holds a plurality of individual contacts 364 (shown in FIG. 8) that extend between the mating interface 316 and the mounting interface 318.

The daughtercard connector 304 includes a housing 330 defined by a plurality of contact modules 332 and end walls 333. One end wall 333 has been removed to illustrate the contact modules 332. The contact modules 332 hold individual contacts 336 that extend between the mating interface 312 and the mounting interface 314.

Each contact module 332 includes one or more holder(s) 334 that holds a plurality of the contacts 336 and a supporting wall 335 that supports the holders 334. The supporting wall 335 may be fabricated from a metal material or a metallized plastic material to provide shielding between adjacent holders 334. The end walls 333 are coupled to corresponding supporting walls 335 to enclose the holders 334.

The holders 334 may hold contacts 336 on both sides of the holder 334. The holder 334 includes a plurality of rails 337 that are separated by slots 338 between the rails 337. Portions of the supporting wall 335 and/or the end wall 333 may extend into the slots 338 to provide shielding between the contacts 336 on different rails 337. Each rail 337 holds corresponding contacts 336. The rails 337 have fingers 339 at the mating ends thereof, and the contacts 336 extend along the fingers 339. Optionally, the contacts 336 are exposed along the fingers 339 for mating with the backplane connector 302. Optionally, the holder 334 may include a right side and a left side, which are separate components, that are coupled together. The right side holds contacts 336 and the left side holds contacts 336.

In an exemplary embodiment, the holder 334 is manufactured from a dielectric material. For example, the holder 334 may be molded from a plastic material. The contacts 336 are arranged on the sides of the holder 334 on corresponding rails 337. Optionally, the contacts 336 may be deposited on the sides of the holder 334. Alternatively, the holder 334 may be molded around the contacts 336. In other alternative embodiments, the contacts 336 are embedded in the holder 334, such as by overmolding the body over the contacts 336.

The contacts 336 extend from a mounting end 340 of the corresponding holder 334. In an exemplary embodiment, the portions of the contacts 336 extending from the mounting end 314 constitute compliant pins, such as eye-of-the-needle pins, that are press-fit-into corresponding vias in the daughtercard circuit board 308.

The end wall 333 is mounted to the outermost supporting wall 335. The end wall 333 provides electrical shielding between the contact module 332 and an adjacent contact module 332. In an exemplary embodiment, the end wall 333 is electrically grounded. For example, the end wall 333 may be electrically connected to the supporting wall 335 and/or separate shields 342 held by the contact modules 332. The shields 342 may be electrically connected to grounded components of the backplane connector 302.

The backplane connector 302 includes a plurality of contact towers 360 extending into the chamber 310. The contact towers 360 are manufactured from a dielectric material, such as a plastic material. Optionally, the contact towers 360 may be separately provided from, and coupled to, the housing 322. Alternatively, the contact towers 360 may be integrally formed with the housing 322. The contacts towers 360 include receptacles 362 (shown in FIG. 8) therein that receive the fingers 339 of the holders 334 and the contacts 336 of the daughtercard connector 304 when the daughtercard connector 304 is mated with the backplane connector 302. Contacts 364 (shown in FIG. 8) of the backplane connector 302 are also received in the receptacles 362 for mating with the contacts 336.

When the daughtercard connector 304 is coupled to the backplane connector 302, the shields 342 are positioned between the contact towers 360. In an exemplary embodiment, the shields 342 extend between the rows of contact towers 360. The supporting walls 335 of the daughtercard connector 304 extend between the columns of contact towers 360. The shields 342 and supporting walls 335 cooperate to provide circumferential shielding around the contact towers 360. The shields 342 may be electrically grounded. For example, the shields 342 may be electrically connected to the contact towers 360, which may be electrically grounded. The shields 342 may be electrically connected to the supporting walls 335 and/or the end walls 333, which may be metal or metallized and electrically grounded, such as by being electrically connected to a ground layer of the backplane circuit board 306.

Figure 8:
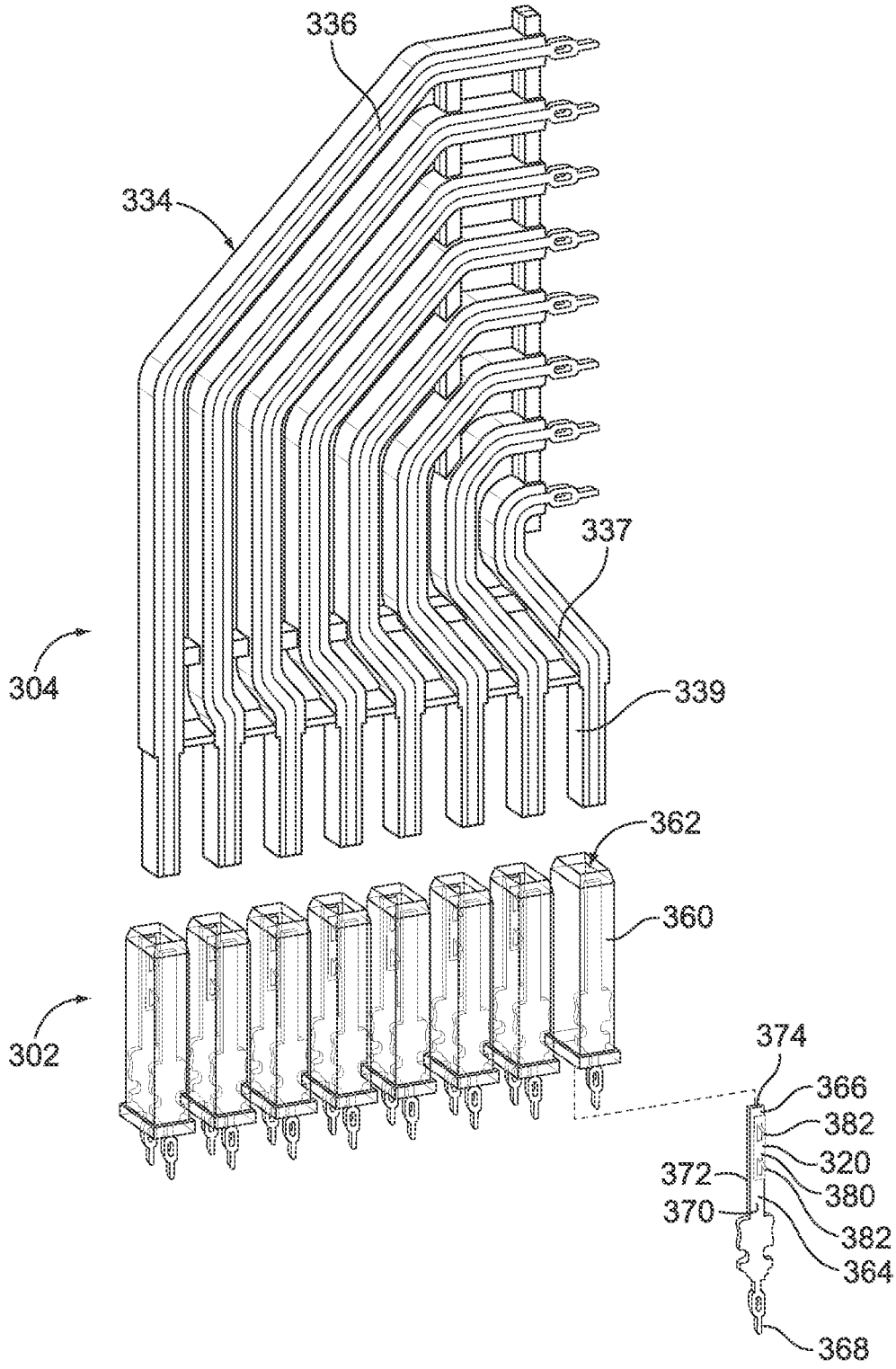
FIG. 8 is a perspective view of a portion of the daughtercard connector poised with mating with a portion of the backplane connector shown in FIG. 7.

FIG. 8 is a perspective view of a portion of the daughtercard connector 304 poised for mating with a portion of the backplane connector 302. FIG. 8 illustrates one of the holders 334, with the contacts 336, but with the supporting wall 335 (shown in FIG. 7) removed for clarity. FIG. 8 also illustrates one row of contact towers 360, but with the housing 322 (shown in FIG. 7) removed for clarity. The contact towers 360 are shown as being see-through to show the contacts 364 in the receptacles 362. FIG. 8 also illustrates one of the contacts 364 of the backplane connector 302 poised for loading into the receptacle 362 of the contact tower 360. The interface contact 320 is shown mounted to the contact 364. In an exemplary embodiment, two contacts 364 are loaded into each receptacle 362 and arranged on opposite sides of the receptacle 362 for mating with the contacts 336 on both sides of the rails 337.

The contact 364 may be similar to the contact 164 (shown in FIG. 4). The contact 364 extends between a mating end 366 and a mounting end 368. The contact 364 has generally planar sides 370, 372 extending to a tip 374 at the mating end 366. The mounting end 368 is configured to be terminated to the backplane circuit board 306 (shown in FIG. 7). In an exemplary embodiment, the contact 364 includes a compliant pin at the mounting end 368 that is configured to be received in a corresponding via in the backplane circuit board 306.

In an exemplary embodiment, the interface contact 320 is separately provided from the contact 364. For example, the interface contact 320 may be separately manufactured and mounted to the contact 364 prior to loading the contact 364 into the receptacle 362. The interface contact 320 is mounted to the side 370 proximate to the tip 374 at the mating end 366. The interface contact 320 may be mechanically secured to the side 370 by a welding process such as spot welding or laser welding the interface contact 320 to the contact 364. The interface contact 320 may be secured to the contact 364 by other processes or means, such as soldering, using a conductive adhesive or epoxy, crimping, or other securing processes. The interface contact 320 is relatively small compared to the contact 364.

The interface contact 320 has a base 380 and one or more spring beams 382 extending from the base 380. In an exemplary embodiment, the base 380 is generally planar and is mounted to the side 370 of the contact 364. The spring beams 382 extend from the base 380 away from the side 370 of the contact 364. The spring beams 382 are configured to engage the contact 336 of the daughtercard connector 304 to make an electrical connection between the contact 364 and the contact 336 of the daughtercard connector 304. Having multiple spring beams 382 provides multiple points of contact between the contact 364 and the contact 336.

When the daughtercard connector 304 is mated with the backplane connector 302, the fingers 339 of the rails 337 are loaded into corresponding receptacles 362 of the contact towers 360. The contacts 364 are arranged within the receptacles 362 such that the interface contacts 320 face the center of the corresponding receptacle 362. The rails 337 have contacts 336 on both sides thereof. In an exemplary embodiment, the contacts 336 on both sides of the rails 337 are configured to carry differential signals. When the daughtercard connector 304 is mated with the backplane connector 302, the planar sides of the contacts 336 are mated with the spring beams 382 of the interface contacts 320. Having multiple spring beams 382 provides multiple points of contact with the contact 336.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector system comprising:

a backplane connector comprising a housing and a plurality of contacts held by the housing of the backplane connector, the housing of the backplane connector being configured to be mounted to a backplane circuit board, the contacts of the backplane connector having mounting ends being configured to be terminated to the backplane circuit board, the contacts of the backplane connector having mating ends opposite the mounting ends;

a daughtercard connector comprising a housing and a plurality of contacts held by the housing of the daughter card connector, the housing of the daughter card connector being configured to be mounted to a daughtercard circuit board, the contacts of the daughter card connector being configured to be terminated to the daughtercard circuit board; and interface contacts separately provided from, and mounted to, the contacts of either the backplane connector or the daughtercard connector, the interface contacts having bases mounted to the corresponding contacts, the interface contacts having spring beams extending from the bases, the spring beams being configured to engage corresponding contacts of the other backplane connector or daughtercard connector when the backplane connector and daughtercard connector are mated together.

2. The electrical connector system of claim 1, wherein each interface contact includes a plurality of spring beams extending from the base.

3. The electrical connector system of claim 1, wherein the interface contacts are mechanically mounted to corresponding contacts, the spring beams defining separable interfaces for mating and unmating with the other contacts.

4. The electrical connector system of claim 1, wherein the interface contacts are welded to sides of the corresponding contacts of either the backplane connector or the daughtercard connector such that the interface contacts are permanently mounted to such contacts, the contacts and interface contacts being loaded into corresponding housing of either the backplane connector or the daughtercard connector as a unit, the spring beams defining separable interfaces for mating and unmating with the other contacts.

5. The electrical connector system of claim 1, wherein the contact of the backplane connector includes a generally planar mating end having planar sides, the contact of the daughtercard connector having planar sides, the backplane connector and daughtercard connector being mated together such that the planar sides of the backplane connector extend along and face the planar sides of the contacts of the daughtercard connector, the interface contacts extending therebetween to electrically connect the contacts of the backplane connector with the contacts of the daughtercard connector.

6. The electrical connector system of claim 1, wherein the contacts of the backplane connector extend to a tip, the contacts of the daughtercard connector extend to a tip, the backplane connector and daughtercard connector being mated together such that the contacts of the backplane connector and the contacts of the daughtercard connector face in opposite directions, the contacts of the backplane connector and the contacts of the daughtercard connector having overlapping sections, the interface contacts being positioned between the overlapping sections, the interface contacts having spring beams positioned proximate to the tips of the contacts of the backplane connector, and the interface contacts having spring beams positioned proximate to the tips of the contacts of the daughtercard connector.

7. The electrical connector system of claim 1, wherein the spring beams are deflected when mated to corresponding contacts to impart a normal force on the contacts to ensure an electrical connection therebetween.

8. The electrical connector system of claim 1, wherein the base extends longitudinally, the interface contact includes a plurality of spring beams extending from the base and being longitudinally offset, the spring beams being angled from the base in a common direction.

9. The electrical connector system of claim 1, wherein the contact of the backplane connector is a stamped contact having a generally planar mating end having planar sides defining a thickness dimension therebetween, the contact of the daughtercard connector is a stamped contact having a generally planar mating end having planar sides defining a thickness dimension therebetween, the backplane connector and daughtercard connector being mated together such that the planar sides of the backplane connector extend along and face the planar sides of the contacts of the daughtercard connector across a gap, a width of the gap being approximately equal to or less than thicknesses of the contacts of the backplane connector and the daughtercard connector, the interface contacts extending across the gap to electrically connect the contacts of the backplane connector with the contacts of the daughtercard connector.

10. An electrical connector system comprising:

a backplane connector comprising a housing having a chamber, the backplane connector comprises contact towers held by the housing, the contact towers having receptacles therein and contacts held by the contact towers, the contacts being exposed within corresponding receptacles, the contacts of the backplane connector having mounting ends being configured to be terminated to a backplane circuit board, the contacts of the backplane connector having mating ends opposite the mounting ends;

a daughtercard connector comprising a housing holding a plurality of contact modules, the contact modules having holders and a plurality of contacts held by the holders, the contact modules having shields between contact modules, the contacts of the daughter card connector being configured to be terminated to a daughtercard circuit board; and interface contacts separately provided from, and mounted to, the contacts of either the backplane connector or the daughtercard connector, the interface contacts having bases mounted to the corresponding contacts, the interface contacts having spring beams extending from the bases, the spring beams being configured to engage corresponding contacts of the other backplane connector or daughtercard connector when the backplane connector and daughtercard connector are mated together.

11. The electrical connector system of claim 10, wherein each interface contact includes a plurality of spring beams extending from the base.

12. The electrical connector system of claim 10, wherein the interface contacts are mechanically mounted to corresponding contacts, the spring beams defining separable interfaces for mating and unmating with the other contacts.

13. The electrical connector system of claim 10, wherein the interface contacts are welded to sides of the corresponding contacts of either the backplane connector or the daughtercard connector such that the interface contacts are permanently mounted to such contacts, the contacts and interface contacts being loaded into corresponding housing of either the backplane connector or the daughtercard connector as a unit, the spring beams defining separable interfaces for mating and unmating with the other contacts.

14. The electrical connector system of claim 10, wherein the contact of the backplane connector includes a generally planar mating end having planar sides, the contact of the daughtercard connector having planar sides, the backplane connector and daughtercard connector being mated together such that the planar sides of the backplane connector extend along and face the planar sides of the contacts of the daughtercard connector, the interface contacts extending therebetween to electrically connect the contacts of the backplane connector with the contacts of the daughtercard connector.

15. The electrical connector system of claim 10, wherein the contacts of the backplane connector extend to a tip, the contacts of the daughtercard connector extend to a tip, the backplane connector and daughtercard connector being mated together such that the contacts of the backplane connector and the contacts of the daughtercard connector face in opposite directions, the contacts of the backplane connector and the contacts of the daughtercard connector having overlapping sections, the interface contacts being positioned between the overlapping sections, the interface contacts having spring beams positioned proximate to the tips of the contacts of the backplane connector, and the interface contacts having spring beams positioned proximate to the tips of the contacts of the daughtercard connector.

16. The electrical connector system of claim 10, wherein the spring beams are deflected when mated to corresponding contacts to impart a normal force on the contacts to ensure an electrical connection therebetween.

17. The electrical connector system of claim 10, wherein the base extends longitudinally, the interface contact includes a plurality of spring beams extending from the base and being longitudinally offset, the spring beams being angled from the base in a common direction.

18. The electrical connector system of claim 10, wherein the contact of the backplane connector is a stamped contact having a generally planar mating end having planar sides defining a thickness dimension therebetween, the contact of the daughtercard connector is a stamped contact having a generally planar mating end having planar sides defining a thickness dimension therebetween, the backplane connector and daughtercard connector being mated together such that the planar sides of the backplane connector extend along and face the planar sides of the contacts of the daughtercard connector across a gap, a width of the gap being approximately equal to or less than thicknesses of the contacts of the backplane connector and the daughtercard connector, the interface contacts extending across the gap to electrically connect the contacts of the backplane connector with the contacts of the daughtercard connector.

* * * * *